United States Patent [19]

Sung

[11] Patent Number: 4,504,279

[45] Date of Patent: Mar. 12, 1985

[54] CORROSION INHIBITED MOTOR FUEL

[76] Inventor: Rodney L. Sung, Fishkill, N.Y.

[21] Appl. No.: 628,935

[22] Filed: Jul. 9, 1984

[51] Int. Cl.[3] ..... C10L 1/22

[52] U.S. Cl. ..... 44/53; 44/63; 44/71; 44/77; 44/56; 252/392; 564/463; 564/508

[58] Field of Search ..... 44/53, 56, 63, 71, 77; 564/463, 508; 252/392

[56] References Cited

U.S. PATENT DOCUMENTS

| | | | |
|---|---|---|---|
| 3,168,567 | 2/1965 | Easton et al. | 564/463 |
| 3,426,072 | 2/1969 | Warner | 564/508 |
| 3,478,096 | 11/1969 | Cyba | 564/508 |
| 4,282,008 | 8/1981 | Sung | 44/63 |
| 4,294,585 | 10/1981 | Sung | 44/63 |
| 4,392,867 | 7/1983 | Sung et al. | 252/392 |

OTHER PUBLICATIONS

Edited by Jacob Zabicky, "The Chemistry of Amides", 1970, pp. 94 and 95.

*Primary Examiner*—Y. Harris-Smith

*Attorney, Agent, or Firm*—Robert A. Kulason; James J. O'Loughlin; Carl G. Seutter

[57] ABSTRACT

A novel fuel composition contains ethanol methanol or gasohol plus, as a corrosion inhibitor, a reaction product of isatoic anhydride and a t-alkyl primary amine which has been further reacted with an alkoxyalkylaminoalkyl amine.

28 Claims, No Drawings

CORROSION INHIBITED MOTOR FUEL

FIELD OF THE INVENTION

This invention relates to a fuel composition for internal combustion engines particularly characterized by corrosion inhibition.

BACKGROUND OF THE INVENTION

As is well known to those skilled in the art, fuel compositions typified by gasohol and alcohols which are to be considered for commercial use must possess low corrosion activity; and this may be effected by addition thereto of various corrosion inhibition systems. It is an object of this invention to provide a fuel composition for internal combustion engines particularly characterized by corrosion inhibition. Other objects will be apparent to those skilled in the art.

STATEMENT OF THE INVENTION

In accordance with certain of its aspects, the fuel composition of this invention may comprise (a) a major portion of a fuel containing (i) at least one alcohol selected from the group consisting of ethanol and methanol and (ii) gasoline in amount of 0–50 volumes per volume of alcohol; and (b) a minor corrosion inhibiting amount of, as a corrosion inhibiting agent, a reaction product of isatoic anhydride and a sterically hindered primary amine which reaction product has been further reacted with an alkoxyalkylaminoalkyl amine.

DESCRIPTION OF THE INVENTION

The fuel for internal combustion engines which may be treated by the process of this invention may contain (i) at least one alcohol selected from the group consisting of ethanol and methanol and (ii) gasoline in amount of 0–50 volumes per volume of alcohol. The fuel may be an alcohol-type fuel containing little or no hydrocarbon. Typical of such fuels are methanol, ethanol, mixtures of methanol-ethanol, etc. Commercially available mixtures may be employed. Illustrative of one such commercially available mixture may be that having the following typical analysis;

TABLE I

| Component | Parts |
|---|---|
| ethanol | 3157.2 |
| methyl isobutyl ketone | 126.3 |
| acetic acid | 0.256 |
| methyl alcohol | 0.24 |
| isopropyl alcohol | 0.2 |
| n-propyl alcohol | 0.162 |
| ethyl acetate | 0.2 |

The fuels which may be treated by the process of this invention include gasohols which may be formed by mixing 90–95 volumes of gasoline with 5–10 volumes of ethanol or methanol. A typical gasohol may contain 90 volumes of gasoline and 10 volumes of absolute alcohol.

It is preferred that the fuels to be treated by the process of this invention be substantially anhydrous i.e. that they contain less than about 0.3 v % water; typically they may contain 0.01 v %–0.005 v %, say about 0.004 v % water.

It is a feature of these fuels that they may undesirably contain acidic contaminants which may cause serious corrosion problems. These contaminants are particularly in evidence when the alcohol is a commercially available alcohol which contains therein inter alia acids concurrently produced as by fermentation processes for producing ethanol or acids which have been picked up during handling. Acetic acid is a common acid present in the commercially available alcohols produced by fermentation; and it may be present in amount of 0.003 w %–0.005 w % of the total of the alcohol.

In accordance with practice of the process of this invention, there may be added to the fuel a minor corrosion inhibiting amount of, as a corrosion inhibiting agent, a reaction product of isatoic anhydride and a sterically hindered primary amine which has been further reacted with an alkoxyalkylaminoalkylamine.

The isatoic anhydride which may be employed in practice of the process of this invention may be characterized by the formula:

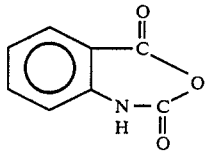

This charge material may bear inert substituents (which do not interfere with the reaction) on the nitrogen atom or on the ring. Typical of these may be alkyl, aralkyl, alkaryl, aryl, or cycloalkyl hydrocarbon substituents. The ring may also bear other inert substituents typified by alkoxy, aryloxy, etc.

The preferred isatoic anhydride is isatoic anhydride se.

The sterically hindered (preferably tertiary alkyl) primary amines which may be employed in practice of the first step of the process of this invention may be characterized by the formula $RNH_2$. R may preferably be an alkyl group containing a tertiary carbon bonded to the nitrogen atom. Thus the structure in one embodiment may include the configuration:

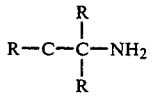

wherein R is a hydrocarbon group such as alkyl, alkaryl, aralkyl, cycloalkyl, or aryl hydrocarbon. Typical of such structure may be:

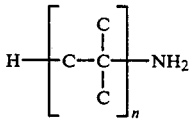

The R group may bear inert substituents which do not interfere with the course of the reaction such as alkyl, aralkyl, aryl, aralkyl, cycloalkyl, alkoxy etc. Preferably the R group contains 4–22 carbon atoms, more preferably 12–20 carbon atoms, say 18 carbon atoms.

Tertiary alkyl primary amines which may be employed include those listed in the following table, the first listed being most preferred.

TABLE

A. 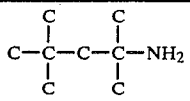

B. 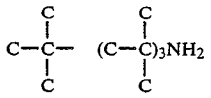

C. 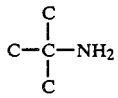

D. 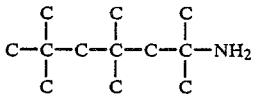

E. 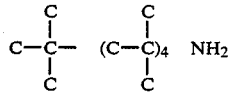

Other sterically hindered amines may be typified by 2,5-dimethyl aniline; 2,5-diethyl aniline, etc.

The process of this invention may be carried out by adding isatoic anhydride and the sterically hindered, preferably tertiary alkyl primary amine (preferably in substantially equimolar quantities) to a reaction vessel together with a polar solvent such as dimethylformamide. Reaction may be carried out at 75° C.–150° C., say 120° C., for typically 4–12 hours, say 8 hours.

At the end of the reaction period, the reaction mixture may be cooled to ambient temperature of 20° C.–30° C., say 25° C. and filtered and then stripped (as by distillation at 80° C.–100° C., say 120° C.) of solvent.

The residue which is generally a waxy solid or viscous liquid is recovered in yield approaching stoichiometric.

Although the first product so prepared may be found to possess activity as a rust and corrosion inhibitor, it is preferred to react it further.

In the preferred embodiment, the first product is not isolated, but is reacted further with substantially an equimolar amount of an alkoxyalkylaminoalkyl amine typically having the formula $$R'—O—(CH_2)_n—N—(CH_2)_m—NH_2$$

wherein R' is a $C_4$–$C_{13}$ alkyl hydrocarbon group, n is 2–3, and m is 2–3. In the preferred embodiment n is 3 and m is 3.

Illustrative di-amines which may be employed include the following, the first being the most preferred;

TABLE

A. $C_{13}H_{27}O(CH_2)_3NH(CH_2)_3NH_2$
B. $C_{12}H_{25}O(CH_2)_3NH(CH_2)_3NH_2$
C. $C_{11}H_{23}O(CH_2)_3NH(CH_2)_3NH_2$
D. $C_{13}H_{27}O(CH_2)_3NH(CH_2)_2NH_2$
E. $C_{13}H_{27}O(CH_2)_2NH(CH_2)_3NH_2$

Practice of this second step of the process of this invention may be carried out by adding the alkoxyalkylaminoalkylamine to the stripped reaction mixture (preferably in equimolar proportions) at ambient temperature of 20° C.–30° C., say 25° C. and stirring for 10–60 minutes, say 60 minutes. The salt so formed may be analyzed by IR and NMR.

Typical of the products so prepared may be those noted in the following table:

TABLE

I. The reaction product of isatoic anhydride and t-octadecylamine which has been further reacted with tridecyloxypropylaminopropylamine;

II. The reaction product of isatoic anhydride and t-nonyldecylamine which has been further reacted with tridecyloxyethylaminoethylamine;

III. The reaction product of isatoic anhydride and t-heptadecylamine which has been further reacted with decyloxypropylaminopropylamine;

IV. The reaction product of isatoic anhydride and t-hexadecylamine which has been further reacted with decyloxypropylaminopropylamine;

V. The reaction product of isatoic anhydride and t-pentadecylamine which has been further reacted with undecyloxypropylaminopropylamine The so prepared rust and corrosion inhibitor may be added to fuels (including alcohol, gasoline, gasohol, etc.) or to antifreeze. These compositions may be particularly found to be effective as rust and corrosion inhibitors when added to absolute alcohol fuels typified by those available commercially containing components including ethers, esters, acids, etc.

The so prepared rust and corrosion inhibitors may be added to a fuel in amount of 0.25–25 PTB, preferably 1–20 PTB, more preferably 1–10 PTB, say 10 PTB. (PTB stands for pounds of additive per thousand barrels of fuel.) Alternatively expressed, the inhibitor may be added to a fuel in minor corrosion-inhibiting amount of 0.0001–0.01 w %, preferably 0.0004–0.008 w %, more preferably 0.0004–0.0040 w %, say 0.0040 w %. Larger amounts may be employed but may not be necessary.

It is a feature of this invention that the fuel composition so prepared is characterized by its increased corrosion and rust inhibition i.e. its decreased ability to form rust on iron surfaces in the presence of aqueous acid systems.

The corrosive nature of the formulated products may be readily measured by the Iron Strip Corrosion Test (ISCT). In this test, an iron strip (12 mm×125 mm×1 mm) is prepared by washing in dilute aqueous hydrochloric acid to remove mill scale, then with distilled water to remove the acid, then with acetone-followed by air drying. The strip is then polished with #100 emery cloth.

The polished strip is totally immersed in 110 ml of the test liquid in a 4 ounce bottle for 15 minutes at room temperature of 20° C. 20 ml of the test liquid is poured off and replaced with 20 ml of distilled water. The bottle is shaken as the sample is maintained for 3 hours at 90° F. The percent rust on the strip is determined visually. A second reading is taken after 40 hours.

The inhibited fuels of this invention, after 40 hours of ISCT generally show a Rust and Corrosion rating below about 2–3% and frequently as low as trace-to-1%.

DESCRIPTION OF PREFERRED EMBODIMENT

Practice of this invention will be apparent to those skilled in the art from the following examples wherein, as elsewhere in this specification, all parts are parts by weight unless otherwise specified.

EXAMPLE I

In this example which illustrates the best mode known to me of preparing the product of this invention, 41 parts of isatoic anhydride, 200 parts of dimethylformamide DMF, and 83 parts of Rohm and Haas Primene JM-T brand of mono-($C_{18}$–$C_{22}$t-alkyl) primary amine may be refluxed in a reaction vessel for 8 hours. The mixture is then filtered and stripped of DMF by heating to 120° C. for 2 hours. In this embodiment, the first or intermediate product is not separated but is further reacted by stirring for 1 hour at 25° C. with 78 parts of the Torah DA-17 brand of tridecyloxy propylaminopropylamine. Product is analyzed by IR and NMR.

EXAMPLE II

The additive prepared in Example I (382 ppm corresponding to 100 PTB) is added to 90 parts of the anhydrous alcohol composition of Table I and 10 parts of distilled water and the resulting composition was tested in the ISCT to determine the Rust and Corrosion rating after 6 days.

EXAMPLE III*

The procedure of Example II was duplicated except that the additive was 76 PTB of a commercial rust and corrosion inhibitor.

The fuel composition was tested in the ISCT.

*designates a control example; all others are experimental examples.

EXAMPLE IV*

The procedure of Examples I–II was duplicated except that no additive was present—only 10 parts of distilled water.

The results of the Iron Strip Corrosion Test were as follows:

TABLE

| Example | 6 Day Rust & Corrosion Rating |
|---|---|
| II | 0 |
| III* | 100% |
| IV* | 100% |

From the above table, it will be apparent that the system of Example II, prepared in accordance with practice of the process of this invention, showed no rust and corrosion. Control Examples III*–IV* showed 100% rust and corrosion which is unsatisfactory.

*designates a control example, all others are experimental examples

Results comparable to those of Example II may be obtained when the sterically hindered primary amine reacted is (in each instance, the tertiary carbon is bonded to the nitrogen):

TABLE

| Example | Primary Amine |
|---|---|
| V | t-dodecylamine |
| VI | t-heptadecylamine |
| VII | t-hexadecylamine |

Results comparable to those of Example I may be obtained when the isatoic anhydride reactant is:

TABLE

| Example | Reactant |
|---|---|
| VIII | 3-methyl isatoic anhydride |
| IX | 3-ethyl isatoic anhydride |
| X | 3-propyl isatoic anhydride |

TABLE-continued

| Example | Reactant |
|---|---|
| XI | 3-butyl isatoic anhydride |

Results comparable to those of Example II may be obtained if the fuel is as follows:

TABLE

| Example | Fuel |
|---|---|
| XV | Gasohol containing 90 v % gasoline and 10 v % absolute ethanol |
| XVI | absolute ethanol |
| XVII | absolute methanol |

Although this invention has been illustrated by reference to specific embodiments, it will be apparent to those skilled in the art that various changes and modifications may be made which clearly fall within the scope of this invention.

I claim:

1. A fuel composition for internal combustion engines comprising (a) a major portion of a fuel containing (i) at least one alcohol selected from the group consisting of ethanol and methanol and (ii) gasoline in amount of 0–50 volumes per volume of alcohol; and (b) a minor corrosion inhibition amount of, as a corrosion inhibiting agent, a reaction product in polar solvent of (i) isoatoic anhydride and (ii) a sterically hindered primary amine which reaction product has been further reacted at ambient temperature with (iii) an alkoxyalkylaminoalkylamine.

2. A fuel composition for internal combustion engines as claimed in claim 1 wherein said fuel is an alcohol.

3. A fuel composition for internal combustion engines as claimed in claim 1 wherein said fuel is methanol.

4. A fuel composition for internal combustion engines as claimed in claim 1 wherein said fuel is ethanol.

5. A fuel composition for internal combustion engines as claimed in claim 1 wherein said fuel is a commercial ethanol.

6. A fuel composition for internal combustion engines as claimed in claim 1 wherein said fuel is a commercial ethanol containing acid.

7. A fuel composition for internal combustion engines as claimed in claim 1 wherein said fuel is a commercial ethanol containing acetic acid.

8. A fuel composition for internal combustion engines as claimed in claim 1 wherein said fuel is a gasohol.

9. A fuel composition for internal combustion engines as claimed in claim 1 wherein said fuel is substantially anhydrous.

10. A fuel composition for internal combustion engines as claimed in claim 1 wherein said fuel contains less than 0.3 v % water.

11. A fuel composition for internal combustion engines as claimed in claim 1 wherein said isatoic anhydride is isatoic anhydride se.

12. A fuel composition for internal combustion engines as claimed in claim 1 wherein said sterically hindered primary amine is a $C_4$–$C_{22}$ tertiary alkyl primary amine.

13. A fuel composition for internal combustion engines as claimed in claim 1 wherein said sterically hindered primary amine is a $C_{12}$–$C_{22}$ tertiary alkyl primary amine.

14. A fuel composition for internal combustion engines as claimed in claim 1 wherein said sterically hindered primary amine is a $C_{18}$–$C_{22}$ tertiary alkyl primary amine.

15. A fuel composition for internal combustion engines as claimed in claim 1 wherein said alkoxyalkylaminoalkyl amine is tridecyloxypropylaminopropylamine.

16. A fuel composition for internal combustion engines as claimed in claim 1 wherein said alkoxyalkylaminoalkyl amine is dodecyloxypropylaminopropylamine.

17. A fuel composition for internal combustion engines as claimed in claim 1 wherein said alkoxyalkylaminoalkyl amine is decyloxypropylaminopropylamine.

18. A fuel composition for internal combustion engines as claimed in claim 1 wherein said agent is the reaction product of isatoic anhydride and $C_{18}$–$C_{22}$ tertiary alkyl primary amine which has been further reacted with tridecyloxypropylaminopropylamine.

19. A fuel composition for internal combustion engines as claimed in claim 1 wherein said corrosion inhibiting agent is present in minor corrosion inhibiting amount of 0.00001 w %–0.01 w % of said fuel composition.

20. A fuel composition for internal combustion engines comprising (a) a major portion of a fuel containing absolute ethanol; and (b) a minor corrosion inhibiting amount, 0.0001 w %–0.005 w % of said fuel composition, of as a corrosion inhibiting agent, a reaction product in polar solvent of (i) isatoic anhydride and (ii) $C_{18}$–$C_{22}$ tertiary alkyl primary amine which reaction product has been further reacted at ambient temperature with (iii) tridecyloxypropylaminopropylamine.

21. A composition comprising a reaction product in polar solvent of (i) isatoic anhydride and a sterically hindered primary amine which reaction product has been further reacted at ambient temperature with (iii) an (ii) alkoxyalkylaminoalkylamine.

22. A composition as claimed in claim 20 wherein said sterically hindered amine is a $C_{12}$–$C_{22}$ tertiary alkyl primary amine.

23. A composition as claimed in claim 20 wherein said sterically hindered amine is a $C_{18}$–$C_{22}$ tertiary alkyl primary amine.

24. A composition as claimed in claim 20 wherein said alkoxyalkylaminoalkyl amine is tridecyloxypropylaminopropylamine.

25. A composition as claimed in claim 20 wherein said alkoxyalkylaminoalkyl amine is dodecyloxypropylaminopropylamine.

26. A composition as claimed in claim 20 wherein said alkoxyalkylaminoalkyl amine is decyloxypropylaminopropylamine.

27. A composition as claimed in claim 20 wherein said agent is the reaction product of isatoic anhydride and $C_{18}$–$C_{22}$ tertiary alkyl primary amine which has been further reacted with tridecyloxypropylaminopropylamine.

28. A composition as claimed in claim 20 wherein composition is the reaction product of isatoic anhydride and $C_{18}$–$C_{22}$ tertiary alkyl primary amine which has been further reacted with tridecyloxypropylaminopropylamine.

* * * * *

UNITED STATES PATENT AND TRADEMARK OFFICE

CERTIFICATE OF CORRECTION

PATENT NO. : 4,504,279

DATED : 12 March 1985

INVENTOR(S) : RODNEY L. SUNG

It is certified that error appears in the above—identified patent and that said Letters Patent is hereby corrected as shown below:

The Cover Sheet should show that the patent is assigned to Texaco, Inc., White Plains, N. Y.

Signed and Sealed this

Twenty-fourth Day of February, 1987

*Attest:*

DONALD J. QUIGG

*Attesting Officer* *Commissioner of Patents and Trademarks*